US011626094B2

(12) United States Patent
Lee et al.

(10) Patent No.: US 11,626,094 B2
(45) Date of Patent: Apr. 11, 2023

(54) MEMBRANE ACOUSTIC ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing, Inc., Plano, TX (US)

( * ) Notice: Subject to any disclaimer, the term of this patent is extended or adjusted under 35 U.S.C. 154(b) by 345 days.

(21) Appl. No.: 16/807,660

(22) Filed: Mar. 3, 2020

(65) Prior Publication Data

US 2021/0280161 A1 Sep. 9, 2021

(51) Int. Cl.
*G10K 11/172* (2006.01)
*G10K 11/162* (2006.01)

(52) U.S. Cl.
CPC ..... *G10K 11/172* (2013.01); *G10K 11/162* (2013.01)

(58) Field of Classification Search
CPC ..... G10K 11/17857; G10K 2210/1282
USPC ..... 381/71.14, 71.13
See application file for complete search history.

(56) References Cited

U.S. PATENT DOCUMENTS 6,073,723 A * 6/2000 Gallo ..... H04R 1/288 181/146
6,090,478 A * 7/2000 Nishizaki ..... G10K 11/16 428/297.4
6,581,722 B2 6/2003 Faulhaber et al.
7,837,008 B1 * 11/2010 Lane ..... B64G 1/46 181/207
10,119,589 B2 11/2018 Schaedler et al.
2014/0020158 A1 * 1/2014 Parsons ..... A42B 3/127 2/413

(Continued)

FOREIGN PATENT DOCUMENTS

WO 2016083971 A1 6/2016

OTHER PUBLICATIONS

Scopus Tuned Membrane Bass Trap (T100). GikAcoustics. https://www.gikacoustics.com/product/gik-acoustics-scopus-tuned-bass-trap-t100/. Date Accessed: Nov. 11, 2019, 7 pages.

(Continued)

*Primary Examiner* — Alexander Krzystan
(74) *Attorney, Agent, or Firm* — Christopher G. Darrow; Darrow Mustafa PC

(57) ABSTRACT

A membrane-type acoustic absorber structure is provided for an acoustic panel. The absorber structure includes an acoustic substrate. A plurality of spaced apart unit cells are provided in the acoustic substrate and arranged in a periodic array. Each unit cell includes at least one perimeter boundary wall and a bottom wall portion. The perimeter boundary wall and bottom wall portion cooperate to define a chamber with an opening and a chamber cavity having a chamber volume. An elastic membrane is disposed at the chamber opening and configured for sealing the chamber cavity. At least one lossy porous medium is provided aligned with, and separated a distance from, the elastic membrane. A fluid/gas is provided in the chamber volume. In certain aspects, the unit cells may have identical dimensions, having the same resonance frequency. In other aspects, the unit cells may have different dimensions, providing a broadband absorber.

20 Claims, 4 Drawing Sheets

(56) References Cited

U.S. PATENT DOCUMENTS

| | | | | |
|---|---|---|---|---|
| 2016/0071505 | A1* | 3/2016 | Nash | G01N 29/11 73/579 |
| 2016/0293154 | A1* | 10/2016 | Yang | G10K 11/172 |
| 2017/0132999 | A1* | 5/2017 | Coakley | G10K 11/172 |
| 2019/0257079 | A1* | 8/2019 | Smith | E04B 1/86 |
| 2020/0309028 | A1* | 10/2020 | Murugappan | F04D 29/664 |

OTHER PUBLICATIONS

Yang et al. "Subwavelength total acoustic absorption with degenerate resonators". Applied Physics Letters, 107, 104104 (2015), 5 pages.
Ma et al. "Acoustic metasurface with hybrid resonances," Nature Material 3994 (2014), 6 pages.
Chen et al., "A Review of Tunable Acoustic Metamaterials". Appl. Sci. 2018, 8(9), 1480, 21 pages.
Zhu et al., "Broadband ultra-thin acoustic metasurface absorber", 2019 (12 pages).
Yang et al., "Optimal sound absorbing structures", Proceedings of Meetings on Acoustics, vol. 32, 2017 (5 pages).
Jimenez et al., "Rainbow-trapping absorbers: Broadband, perfect and asymmetric sound absorption by subwavelength panels with ventilation", 2017 (13 pages).

* cited by examiner

MEMBRANE ACOUSTIC ABSORBER

TECHNICAL FIELD

The present disclosure generally relates to acoustic metamaterials and, more particularly, to improved membrane-type acoustic absorbers with increased absorption bandwidth.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Low-frequency noise issues are a common issue in a variety of different environments, and in many different industries. In one example pertaining to the automotive industry, low frequency noise has been a long-standing issue for passenger comfort. While there are several solutions for managing low-frequency noises, many may have drawbacks. For example, membrane-type acoustic absorbers can be used for various low frequency and ultra-compact absorbers. Because of its relatively low intrinsic loss, a thin elastic membrane can be combined with a small, rigid mass attached to the membrane so as to amplify the vibration amplitude and thereby increasing the loss. However, these membrane-type absorbers can suffer from a relatively narrow absorption bandwidth, especially as compared to other types of acoustic absorbers. Such metamaterials also frequently have narrow ranges of effective absorption frequency.

Accordingly, it would be desirable to provide an improved acoustic system having the advantages of membrane-type absorbers (low frequency, compact), but with a needed increase in bandwidth, for a broad frequency absorption range.

SUMMARY

This section provides a general summary of the disclosure, and is not a comprehensive disclosure of its full scope or all of its features.

In various aspects, the present teachings provide a unit cell structure for an acoustic panel substrate. The unit cell structure includes at least one perimeter boundary wall and a bottom wall portion. The perimeter boundary wall and bottom wall portion cooperate to define a chamber with an opening and a chamber cavity having a chamber volume. An elastic membrane is disposed at the chamber opening and configured for sealing the chamber cavity. An internal lossy porous medium may be disposed in the chamber cavity. The internal lossy porous medium is aligned with, and separated a distance from, the elastic membrane. A fluid is provided in the chamber volume. In various aspects, an external lossy porous medium may be disposed outside of the chamber cavity. The external lossy porous medium is similarly aligned with, and separated a distance from, the elastic membrane.

In other aspects, the present teachings provide a membrane-type acoustic absorber structure. The absorber structure includes an acoustic substrate. A plurality of spaced apart unit cells are provided in the acoustic substrate and arranged in a periodic array. Each unit cell includes at least one perimeter boundary wall and a bottom wall portion. The perimeter boundary wall and bottom wall portion cooperate to define a chamber with an opening and a chamber cavity having a chamber volume. An elastic membrane is disposed at the chamber opening and configured for sealing the chamber cavity. An internal lossy porous medium may be disposed in the chamber cavity. The internal lossy porous medium is aligned with, and separated a distance from, the elastic membrane. A fluid is provided in the chamber volume. In various aspects, an external lossy porous medium may be disposed outside of at least one chamber cavity. The external lossy porous medium is similarly aligned with, and separated a distance from, the elastic membrane.

In still other aspects, the present teachings provide a broadband membrane-type acoustic absorber structure. The absorber structure includes an acoustic substrate. At least one broadband resonator group is provided in the acoustic substrate. The broadband resonator group includes a plurality of unit cells functioning as acoustic resonators. For example, each broadband resonator group may include between 2 and 9 unit cells. Each unit cell may have a different resonance frequency and includes at least one perimeter boundary wall and a bottom wall portion. The perimeter boundary wall and bottom wall portion cooperate to define a chamber with an opening and a chamber cavity having a chamber volume. An elastic membrane is disposed at the chamber opening and configured for sealing the chamber cavity. An internal lossy porous medium may be disposed in the chamber cavity. The internal lossy porous medium is aligned with, and separated a distance from, the elastic membrane. A fluid is provided in the chamber volume. In various aspects, an external lossy porous medium may be disposed outside of at least one chamber cavity. The external lossy porous medium is similarly aligned with, and separated a distance from, the elastic membrane.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present technology generally provides a membrane-type acoustic absorber structure for an acoustic panel, or similar sound absorbing device. The absorber structure includes an acoustic substrate. The acoustic substrate may be generally planar, or shaped to match a design. A plurality of spaced apart unit cells are provided in the acoustic substrate, which may be arranged in a periodic array. Each unit cell generally includes at least one perimeter boundary wall and a bottom wall portion. The perimeter boundary wall and bottom wall portion cooperate to define a chamber with an opening and a chamber cavity having a chamber volume. An elastic membrane is disposed at the chamber opening and configured for sealing the chamber cavity. At least one lossy porous medium is provided aligned with, and separated a distance from, the elastic membrane. The lossy porous medium can be provided adjacent either one or both sides of the elastic membrane. A fluid, typically a gas, is provided in the chamber volume. In certain aspects, the unit cells may have identical dimensions, having the same resonance frequency. In other aspects, the unit cells may have different dimensions, thus providing a broadband absorber. Accordingly, the sound-absorbing structures of the present teachings, in contrast to competing structures, can provide high absorbance across a broad frequency range by combining multiple unit cell designs for different frequencies.

Figure 1:
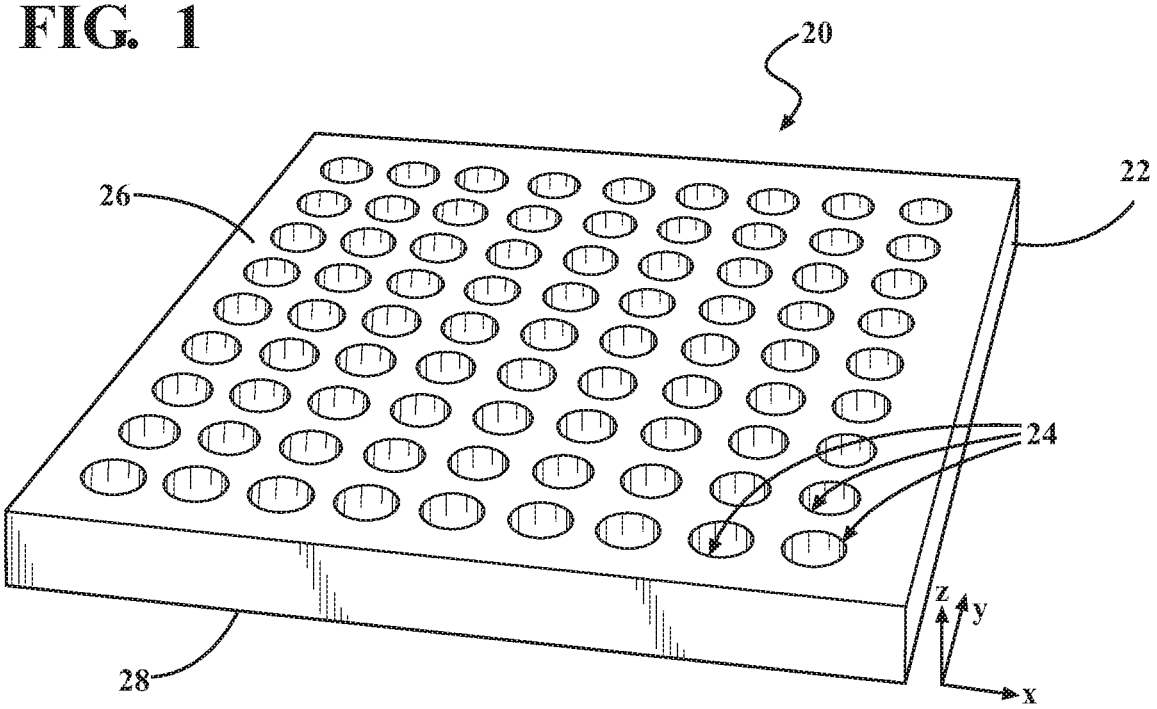
FIG. 1 is a perspective view of an acoustic panel design including an array of spaced-apart unit cell absorber resonators.

The membrane-type acoustic absorber structures of the present technology have unique applicability in various applications that benefit from having a compact, small size and for low frequency use. In one non-limiting example, as shown in FIG. 1, an acoustic panel 20, also referred to as a plate, is provided including an acoustic substrate 22 and a periodic array of unit cell absorber resonators 24 provided within the acoustic substrate 22. In various aspects, the cavities of the chambers of the unit cells 24 are formed in the acoustic substrate 22. With regard to the overall design of the acoustic structure, while the acoustic panel 20 is shown as a square-shaped, planar panel, it should be understood that the shape and size of the acoustic panel 20 can vary based on the desired end use. The acoustic substrate 22 may be made of what is referred to as an acoustically solid or hard material, such as metal, glass, wood, plastic, a thermoplastic resin, such as polyurethane, a ceramic, or any other suitable material. As shown, the acoustic substrate 22 has first and second opposing major surfaces 26, 28. The upwardly facing major surface 26 defines a plurality of openings that form the cavities, or chambers, of the unit cells 24, as will be discussed below. The opposite, downward facing major surface 28 may generally be substantially smooth and/flat, without any openings.

Figure 2A:
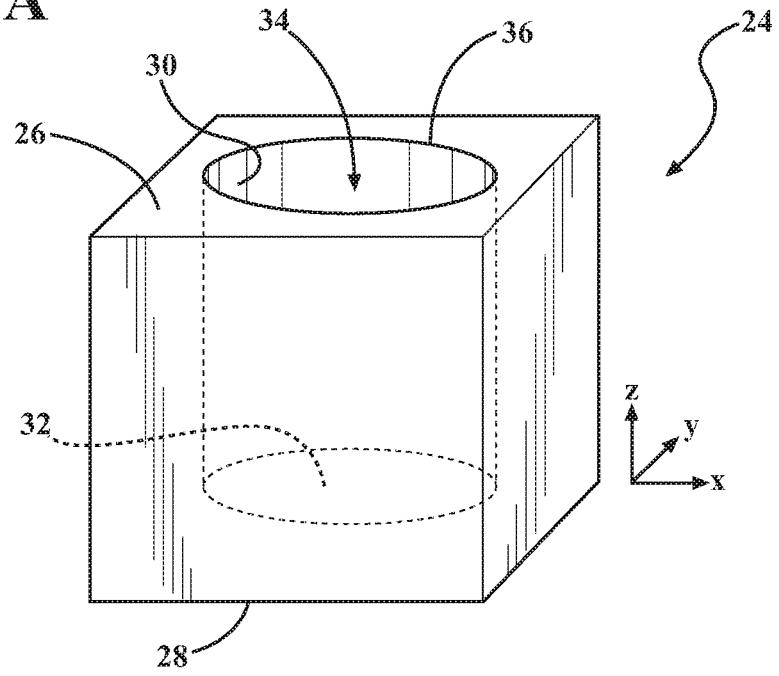
FIG. 2A is a perspective view of an exemplary single unit cell as provided in the acoustic panel of FIG. 1.

FIG. 2A is a perspective view of an exemplary geometry of what is referred to as a single unit cell 24 as provided in the acoustic substrate 22 of the acoustic panel 20 as shown in FIG. 1. The unit cell 24 generally includes at least one perimeter boundary wall 30 and a bottom wall portion 32. Together, the perimeter boundary wall 30 and the bottom wall portion 32 cooperate to define a chamber cavity 34. The chamber cavity 34 has a specified chamber volume V. A chamber opening 36 is located where the chamber cavity 34 meets the upper major surface 26 of the acoustic substrate 22. As shown, the perimeter boundary wall 30 of the unit cell 24 of FIG. 2A defines a cylindrical shape, thus the chamber cavity 34 has a substantially circular cross-section in the longitudinal (z) direction. As shown in FIG. 1, the unit cells 24 of the acoustic panel 20 can be positioned periodically in an array pattern in the acoustic substrate 22. For example purposes only, each unit cell 24 of FIG. 1 is provided with an identical geometry. In other aspects, different geometries can be provided. Still further, certain of the unit cells 24 can alternately have a cross-sectional profile that is non-square rectangular, triangular, diamond, prismatic cylindrical, conical, spherical, equilateral parallelograms, or any other shape that is suitable.

Figure 2B:
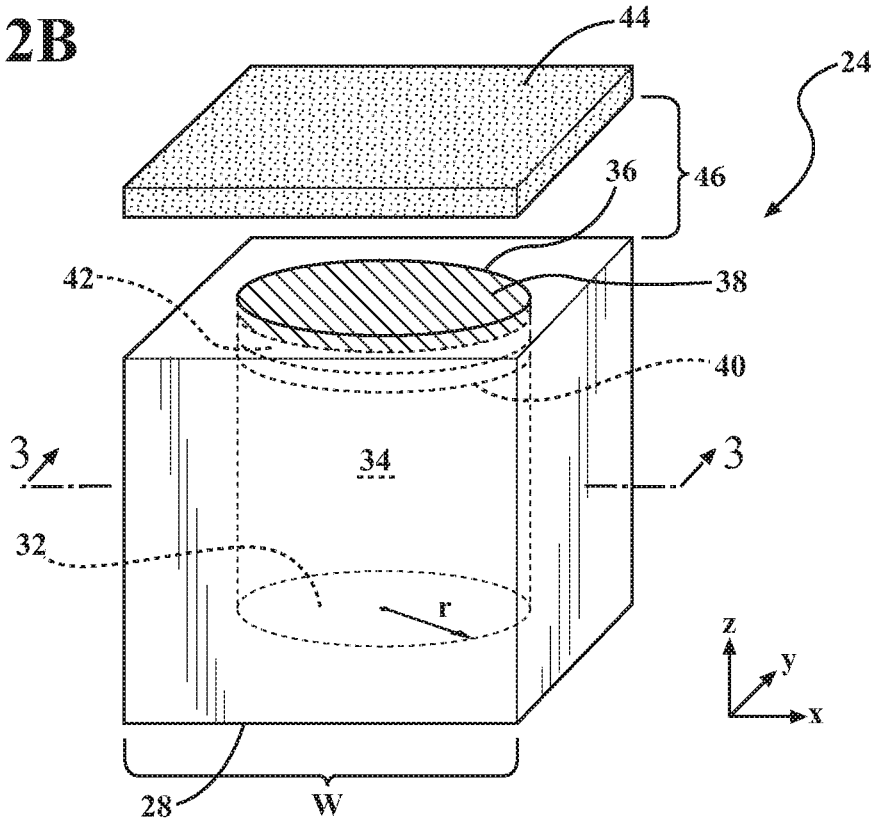
FIG. 2B is a perspective view of the single unit cell absorber resonator of FIG. 2A, shown with an elastic membrane and lossy porous media according to various aspects of the present technology.

FIG. 2B is a perspective view of a single unit cell absorber resonator 24 of FIG. 2A, shown with a thin elastic membrane 38 adjacent to the internal and external lossy porous media 40, 44. In various examples, the present technology provides for the use of either one or both of an internal lossy porous medium 40 (located within an interior the chamber cavity 34) and an external lossy porous medium 44 (located outside of the chamber cavity 34) placed near the elastic membrane 38 The thin elastic membrane 38, together with the chamber cavity 34, functions as an acoustic resonator, concentrating incident acoustic energy near the elastic membrane 38. The lossy porous medium further dissipates acoustic energy into heat.

In various aspects, the elastic membrane 38 may be provided disposed at the chamber opening 36, and is configured for sealing the chamber cavity 34. In various aspects, the chamber cavity 34 is filled with a fluid, such as an inert gas, or air, sealed in the chamber cavity 34. The elastic membrane 38 is preferably uniformly stretched, provided with a radius dimension similar to a radius of the chamber cavity, r, that is sufficient to seal the chamber opening 36. Typically the elastic membrane 38 may be provided with a thickness dimension of less than about 150 μm, or less than about 100 μm, based, at least in part, on the dimensions of the chamber cavity 34. The boundary of the elastic membrane 38 may be fixed to the chamber opening 36 as is known in the art. The sealed gas and the elastic membrane 38 add impedance and change the resonance conditions. The resonance frequency of the elastic membrane 38 is determined by the cavity volume, as well as the elastic properties and physical dimensions of the membrane (i.e., thickness and diameter). In various aspects, the diameter of the chamber opening 36 can range from about 0.5 cm to about 5 cm, or from about 1 cm to about 3 cm.

The internal lossy porous medium 40 is preferably a soft, porous material disposed in the chamber cavity 34 and is aligned with and located adjacent to the elastic membrane 38. In various aspects, the internal lossy porous medium 40 can be secured within the chamber cavity 34 with a tight press-fit against the perimeter boundary wall 30. In other aspects, the perimeter boundary wall 30 may include a shaped retention feature to secure the internal lossy porous medium 40. Similarly, the external lossy porous medium 44 is preferably a soft, porous material disposed external of the chamber cavity 34 and is aligned with and located adjacent to the elastic membrane 38. In various aspects, one or both of the internal and external lossy porous media 40, 44 may be aligned substantially parallel with the elastic membrane 38 and are configured to serve as an acoustically absorbing component having thermal dissipative acoustic properties. In some implementations, the internal and external lossy porous media 40, 44 can have a porosity greater than 0.5, or 0.6, or 0.7, or 0.8, or 0.9. Non-limiting examples of materials useful as a lossy porous medium and suitable for use with the present technology include melamine and various polyurethane foams known in the art that are capable of dissipating acoustic energy to heat. In various aspects, the internal and external lossy porous media 40, 44 may be the same material; in other aspects, they may be different materials. Preferably, the internal lossy porous medium 40 is aligned with, and separated a distance from, the elastic membrane 38, as illustrated by the fixed small gap area 42 between the components. The presence of the gap 42 allows for the vibration of the elastic membrane 38 without any restriction. It should be noted, however, that occasional gentle physical contact between the elastic membrane 38 and the internal and external lossy porous media 40, 44 will not generally change the vibrational characteristics of the elastic membrane 38.

The external lossy porous medium 44 may also be separated a distance, 46, from the elastic membrane 38. The separation distance, 46, between the external lossy porous medium 44 and the elastic membrane 38 may vary based on the design of the structure and the manner in which the external lossy porous medium 44 is mechanically coupled to the acoustic substrate 22. In various aspects, the external lossy porous medium 44 can be provided as a continuous extending sheet of material that is aligned with, and ultimately coupled or secured to, the upper major surface 26 of the acoustic substrate 22. The external lossy porous medium 44 may be disposed adjacent a plurality of unit cells 24. In other aspects, the external lossy porous medium 44 can be a plurality of separate sheets of material secured to an exterior of the acoustic substrate 22. In still other aspects, it is envisioned that certain designs may provide an acoustic panel 20 that may include a plurality of unit cells 24 that have an external lossy porous medium 44, and a plurality of unit cells 24 that may not be provided with an external lossy porous medium 44.

Figure 3:
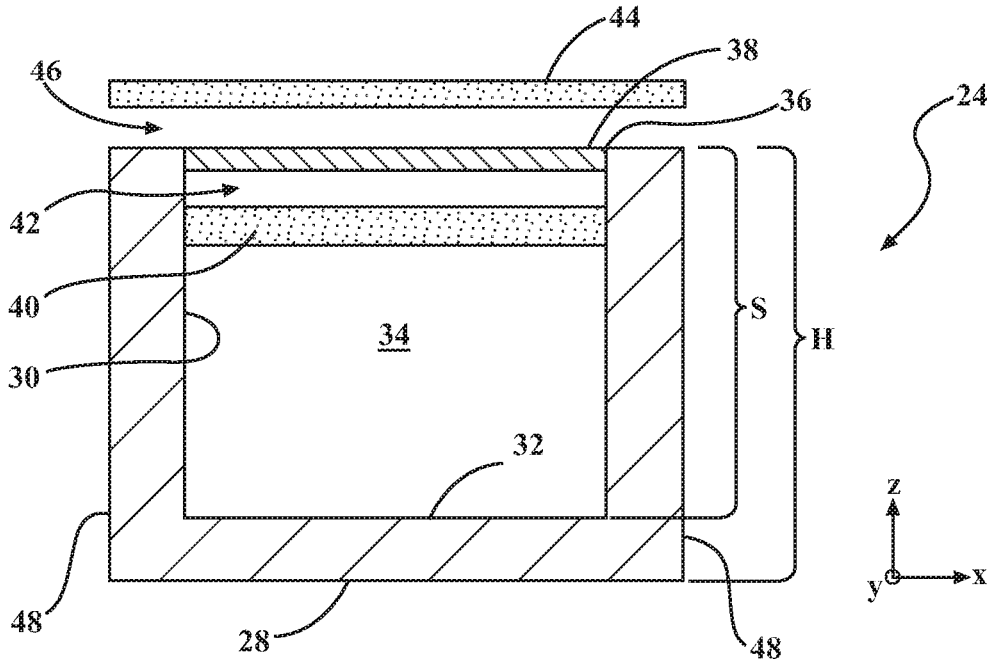
FIG. 3 is a cross-sectional view of the exemplary unit cell absorber resonator taken along the line 3-3 of FIG. 2B.
Figure 6:
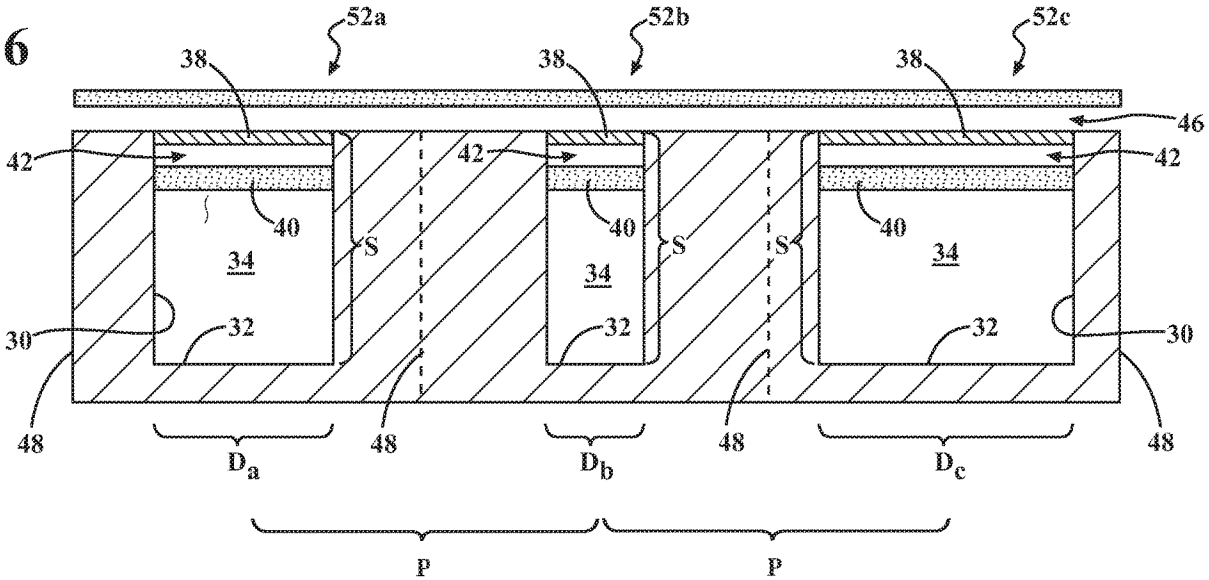
FIG. 6 is a cross-sectional view of one exemplary row of a broadband resonator group taken along the line 6-6 of FIG. 4, showing three unit cells with elastic membranes and lossy porous media.

FIG. 3 is a cross-sectional view of an exemplary unit cell 24 taken along the line 3-3 of FIG. 2B according to various aspects. As shown, S is the overall depth of the chamber cavity 34 of the sealed unit cell 24 between the chamber opening 36 and the bottom wall portion 32, and H is the overall height dimension of the acoustic substrate 22. In various aspects, the height dimension, H, of the acoustic substrate is less than about 50 mm, and generally may vary between about 20 mm up to about 50 mm. The chamber depth dimension, S, can similarly vary, and will be slightly less than the height dimension, H, taking into account the thickness of the bottom wall portion 32. With particular reference to FIGS. 1-3, the unit cells 24 can be periodic in 2-dimensions (e.g. the x, y dimensions of FIGS. 1-3). In this exemplary arrangement, the periodic array of unit cells 24 has periodicity in both x and y dimensions. This can be termed a two-dimensional array. The period, P, of the periodic array of unit cells 24 may generally be substantially smaller than the wavelength of the acoustic waves that the acoustic structure is designed to absorb. Exemplary periodic boundaries 48 of adjacent unit cells are shown in FIG. 6; the period, P, can be equated to a center-to-center distance between the boundaries 48. In various designs, the center to center periodic distance of each unit cell 24 may be the same for the plurality of unit cells in the acoustic panel 20.

With continued reference to FIG. 2B, each unit cell 24 of the periodic array of unit cells will generally have a maximum lateral dimension, or width W. The periodic distance, P, (FIG. 6) is preferably greater than a maximum lateral width dimension, W, of each unit cell 24. The periodic array of unit cells 24 is further characterized by a fill factor equal to W/P. In general, the fill factor will be 0.5 or less. In some implementations, the fill factor will be 0.25 (i.e., 25%) or less. It will be appreciated that the frequency breadth of efficient absorption of a broadband acoustic resonator (i.e., the broadband nature of absorption) is substantially determined by the fill factor of the periodic array of unit cells 24; the ratio of width, W, to period, P, of the unit cells 24. Thus, a large fill factor (W/P) increases the frequency bandwidth, whereas small fill factor (high sparsity) decreases the bandwidth of efficient absorption. The period, P, of the periodic array of unit cells 24 is smaller than the wavelength corresponding to the desired resonance frequency (period<wavelength). At the same time, in many implementations the period, P, and width, W, of unit cells 24 will be chosen so that the periodic array of unit cells 24 has a fill factor of at least 0.2 (i.e., 20%).

Figure 4:
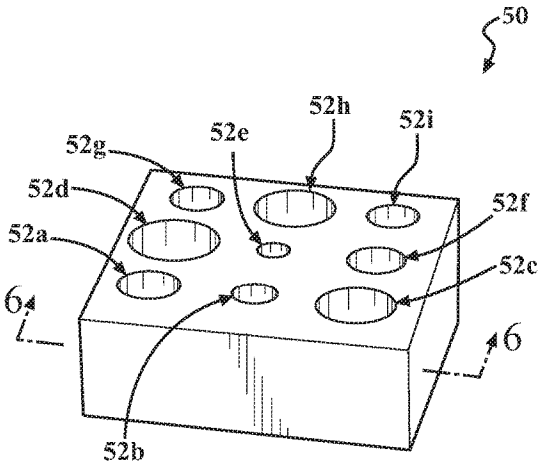
FIG. 4 is a perspective view of an exemplary broadband resonator group including a set of nine unit cell absorber resonators, where each may have a different resonance frequency.

As discussed above, broadband absorption can be realized by combining unit cell absorbers of different resonance frequencies. FIG. 4 is a perspective view of an exemplary broadband resonator group 50, or unit, including a plurality of spaced apart unit cell absorber resonators 52. In various aspects, at least two of plurality of the unit cell absorber resonators 52 will generally be provided having different resonance frequencies. While various design differences can lead to the different resonance frequencies, the present technology generally focuses on a change in the geometry of the unit cells, such as a difference in the chamber volume V, which (as shown) may be based on a diameter of the chamber cavity 34. Of course, with geometries other than a cylinder shaped cavity, other suitable dimensions may be varied. In the specific example shown in FIG. 4, the broadband resonator group 50 is provided as a set of nine different sized unit cell absorber resonators 52*a*-52*i*. In this non-limiting example, each of the nine unit cell absorber resonators 52*a*-52*i* is provided having a different geometry (based on unit cell diameter), and thus, a different resonance frequency, f. In various aspects, the broadband resonator group 50 may include any number of unit cells sufficient for the particular design. In certain aspects, between 2 and 15 unit cells, or between 2 and 9 unit cells may be provided.

Figure 5:
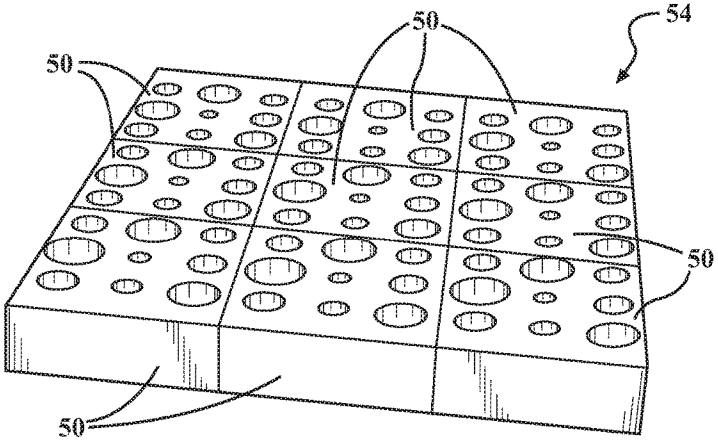
FIG. 5 is a perspective view of a broadband acoustic panel design including a three-by-three array of broadband resonator groups as provided in FIG. 4.

FIG. 5 is a perspective view of a broadband acoustic panel 54 including a three-by-three array of the broadband resonator groups 50 as provided in FIG. 4. It should be understood that while the figures illustrate the array of broadband resonator groups 50 generally having the same repeating set of nine unit cells and their geometries, other aspects may provide multiple sets or arrays of broadband resonator groups 50 with different geometries and/or different properties arranged as a panel.

Functionally, the unit cells 52*a*-52*i* of FIG. 4 are similar to the unit cell 24 previously described above in FIGS. 1-3, and the description of that unit cell is also applicable here. FIG. 6 is a cross-sectional view of one row of unit cells 52*a*-52*c* from the exemplary broadband resonator group 50 of FIG. 4-4, taken along the line 6-6. FIG. 6 provides three unit cells 52*a*, 52*b*, 52*c*, each with elastic membranes 38 and internal and external lossy porous media 40, 44. As shown, the external lossy porous medium 44 can be provided as a continuous sheet of material, aligned with the upper surface of the acoustic substrate and disposed adjacent a plurality of the unit cells 52*a*, 52*b*, 52*c*. In certain aspects, an external lossy porous medium 44 may not be used. The unit cells 52*a*, 52*b*, 52*c* may similarly be spaced apart where the periodic distance is greater than a maximum lateral width dimension of each unit cell. As shown by this row, the difference in geometry is based on the difference in diameter of the chamber cavities 34, with the diameter of $D_a>D_b$, and the diameter of $D_c>D_a$.

Figure 7:
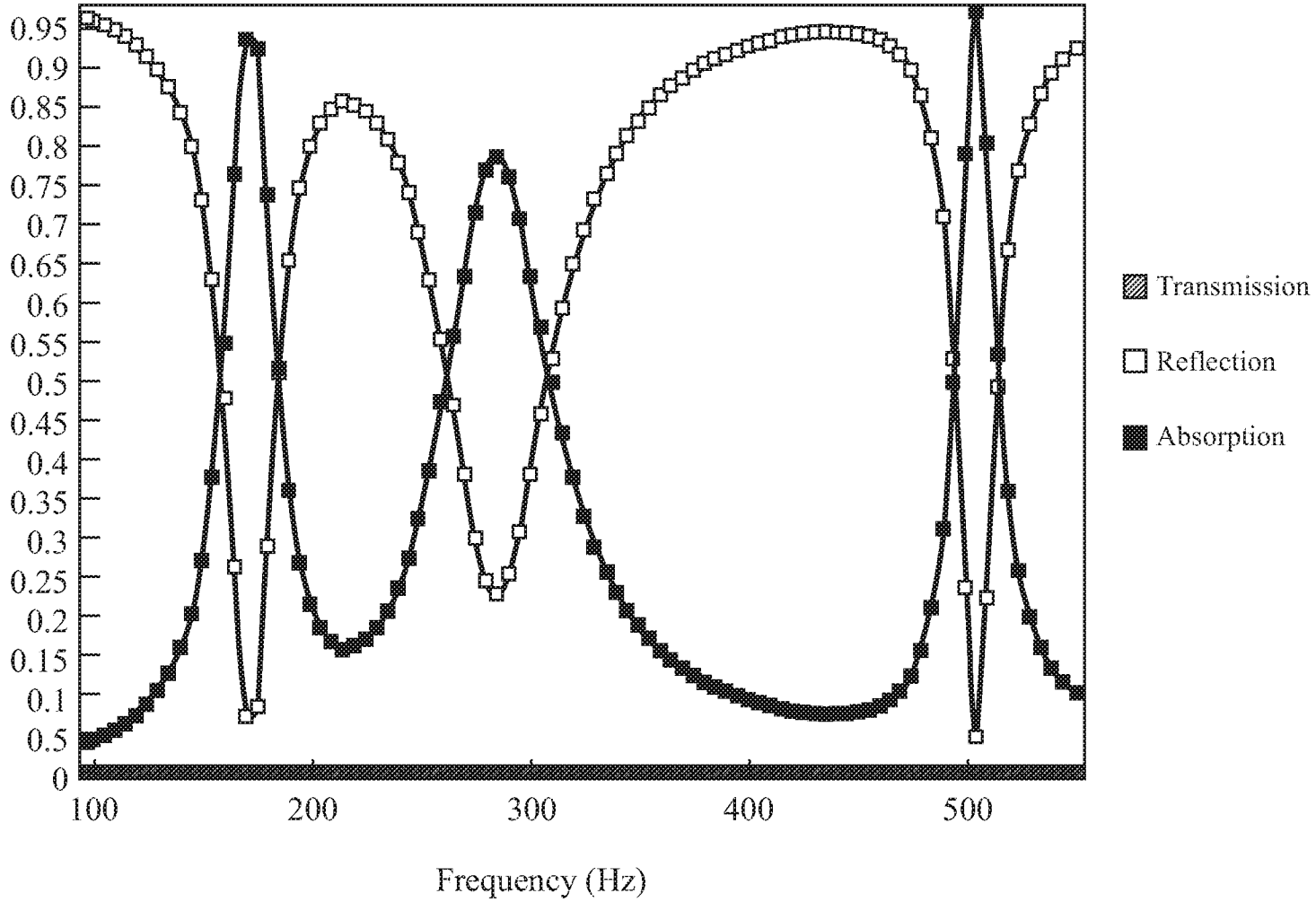
FIG. 7 is a graph of acoustic absorption, reflection, and transmission as a function of frequency for the acoustic panel of FIG. 1, with unit absorbers of an identical dimension.

FIG. 7 is a graph of simulated acoustic absorption, reflection, and transmission (ranging from zero (0) to 1) as a function of frequency for the acoustic panel of FIG. 1, with unit absorbers of an identical dimension. In this example, the acoustic absorption, A, is defined as a ratio of absorbed acoustic power to incident power, with A=1 as being the highest value. In this particular graph, the absorber shows a multiband absorption. Almost perfect acoustic absorption, with A being near 1, is provided at resonance frequencies of about 180 Hz, 300 Hz, and 500 Hz.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A unit cell structure for an acoustic panel substrate, the unit cell structure comprising:

at least one perimeter boundary wall and a bottom wall portion cooperating to define a chamber with a chamber cavity having a chamber volume, the chamber cavity opening to an exterior of the unit cell structure via an opening;

an elastic membrane disposed at the chamber opening and configured for sealing the chamber cavity;

an internal lossy porous medium disposed in the chamber cavity, the internal lossy porous medium being aligned with the elastic membrane, and the internal lossy porous medium being separated a distance from the elastic membrane by a gap, whereby the gap allows for vibration of the elastic membrane; and a fluid provided in the chamber volume.

2. The unit cell structure for an acoustic panel substrate according to claim 1, further comprising an external lossy porous medium disposed outside of the chamber cavity, the external lossy porous medium being aligned with, and separated a distance from, the elastic membrane.

3. An acoustic panel substrate comprising a plurality of unit cells according to claim 1 arranged in a periodic array.

4. A membrane-type acoustic absorber structure, comprising:

an acoustic substrate;

a plurality of spaced apart unit cells provided in the acoustic substrate and arranged in a periodic array, wherein each unit cell functions as an acoustic resonator, and comprises:

at least one perimeter boundary wall and a bottom wall portion cooperating to define a chamber with a chamber cavity having a chamber volume, the chamber cavity opening to an exterior of the unit cell via an opening;

an elastic membrane disposed at the chamber opening and configured for sealing the chamber cavity;

an internal lossy porous medium disposed in the chamber cavity, the internal lossy porous medium being aligned with the elastic membrane, and the internal lossy porous medium being separated a distance from the elastic membrane by a gap, whereby the gap allows for vibration of the elastic membrane; and a fluid provided in the chamber volume.

5. The membrane-type acoustic absorber structure according to claim 4, further comprising an external lossy porous medium disposed outside of the chamber cavity of at least one unit cell, the external lossy porous medium being aligned with, and separated a distance from, the elastic membrane of the at least one unit cell.

6. The membrane-type acoustic absorber structure according to claim 5, wherein the external lossy porous medium is disposed adjacent a plurality of unit cells.

7. The membrane-type acoustic absorber structure according to claim 6, wherein the external lossy porous medium is provided as a continuous extending sheet, aligned with a surface of the acoustic substrate.

8. The membrane-type acoustic absorber structure according to claim 4, wherein each of the plurality of spaced apart unit cells has the same resonance frequency.

9. The membrane-type acoustic absorber structure according to claim 4, wherein at least two of the plurality of spaced apart unit cells have different resonance frequencies.

10. The membrane-type acoustic absorber structure according to claim 4, wherein the perimeter boundary wall defines a cylindrical shape and the chamber cavity has a uniform circular cross-section in a longitudinal direction.

11. The membrane-type acoustic absorber structure according to claim 4, wherein a maximum height dimension of the acoustic substrate is less than about 50 millimeters.

12. The membrane-type acoustic absorber structure according to claim 4, wherein each of the plurality of spaced apart unit cells has identical dimensions.

13. The membrane-type acoustic absorber structure according to claim 4, wherein the internal lossy porous medium comprises melamine or a polyurethane foam.

14. The membrane-type acoustic absorber structure according to claim 4, wherein a center to center periodic distance, P, of each unit cell is the same for the plurality of unit cells.

15. A broadband membrane-type acoustic absorber structure, comprising:

an acoustic substrate; and a broadband resonator group located in the acoustic substrate, the broadband resonator group including a plurality of unit cells functioning as acoustic resonators, each unit cell having a different resonance frequency and comprising:

at least one perimeter boundary wall and a bottom wall portion cooperating to define a chamber with a chamber cavity having a chamber volume, the chamber cavity opening to an exterior of the unit cell via an opening;

an elastic membrane disposed at the chamber opening and configured for sealing the chamber cavity;

an internal lossy porous medium disposed in the chamber cavity, the internal lossy porous medium being aligned with the elastic membrane, and the internal lossy porous medium being separated a distance from the elastic membrane by a gap, whereby the gap allows for vibration of the elastic membrane; and a fluid provided in the chamber volume.

16. The broadband membrane-type acoustic absorber structure according to claim 15, comprising a plurality of broadband resonator groups located in the acoustic substrate and arranged in a periodic array.

17. The broadband membrane-type acoustic absorber structure according to claim 15, further comprising an external lossy porous medium disposed outside of the chamber cavity of at least one unit cell, the external lossy porous medium being aligned with, and separated a distance from, the elastic membrane of the at least one unit cell.

18. The broadband membrane-type acoustic absorber structure according to claim 17, wherein the external lossy porous medium is disposed adjacent a plurality of unit cells, and is aligned with, and separated a distance from, the respective elastic membrane of each of the plurality of unit cells.

19. The broadband membrane-type acoustic absorber structure according to claim 18, wherein the external lossy porous medium is provided as a continuous extending sheet, aligned with a surface of the acoustic substrate.

20. The broadband membrane-type acoustic absorber structure according to claim 15, wherein each broadband resonator group comprises between 2 and 9 unit cells.

* * * * *